United States Patent [19]

Uzaki et al.

[11] Patent Number: 4,561,485

[45] Date of Patent: Dec. 31, 1985

[54] CORE MAKING MACHINE FOR MAKING HOLLOW CORE

[75] Inventors: Nagato Uzaki, Toyohashi; Yasutaro Kawamura, Okazaki; Ryoji Kanayama; Hisashi Harada, both of Toyokawa, all of Japan

[73] Assignee: Sintokogio Ltd., Nagoya, Japan

[21] Appl. No.: 550,148

[22] Filed: Nov. 9, 1983

[30] Foreign Application Priority Data

Nov. 12, 1982 [JP] Japan ..... 57-199630

[51] Int. Cl.[4] ..... B22C 15/22

[52] U.S. Cl. ..... 164/201

[58] Field of Search ..... 164/200, 201, 202, 37, 164/19, 20, 169, 18 B, 234, 228

[56] References Cited

U.S. PATENT DOCUMENTS 506,226 10/1893 Hammer ..... 164/186
2,656,575 3/1950 Herbruggen ..... 164/201
4,239,079 12/1980 Simmons ..... 164/200

FOREIGN PATENT DOCUMENTS 57-159236 1/1982 Japan .
715710 9/1954 United Kingdom ..... 164/234

*Primary Examiner*—Nicholas P. Godici
*Assistant Examiner*—G. M. Reid
*Attorney, Agent, or Firm*—Armstrong, Nikaido, Marmelstein & Kubovcik

[57] ABSTRACT

A core making machine for making a hollow core from green sand, capable of automatically performing a series of core making operation which has the steps of blowing the green sand into a horizontally split type die means from an opening formed in one side of the die means together with air to fill the die cavity, forcibly stabbing the green sand in the die cavity by a stabbing rod to compact and harden the green sand and extracting the rod thereby to form a hollow core, and taking out the thus made core from the die means after it has been splited.

9 Claims, 2 Drawing Figures

CORE MAKING MACHINE FOR MAKING HOLLOW CORE

BACKGROUND OF THE INVENTION

The present invention relates to a core making machine and, more particularly, to a core making machine for making a hollow core from green sand.

In order to facilitate the management of the molding sand and post-treatment of the casting mold, as well as the repeated use of the molding sand, the core in a casting mold is preferably made from the same type of molding sand as that used for making the mold, i.e. green sand. Various attempts to make a core from green sand have encountered difficulty due to inferior fluidity and filling property inherent in the green sand. In addition, the core made from green sand does not show good collapsibility after pouring of molten metal and small permeability to gas. For these reasons, the core making from green sand has not been put into practical use, nor the machines for making core from green sand has been developed yet.

SUMMARY OF THE INVENTION

Accordingly, it is a primary object of the invention to provide a core making machine which can make easily and reliably a hollow core having sufficient strength and good collapsibility from green sand, thereby to overcome the above-described problems of the prior art.

To this end, according to the invention, there is provided a core making machine for making a hollow core from green sand comprising: a horizontally split type die means including a lower die and an upper die movable relatively to the lower die, the lower and upper dies being adapted to define, when they are jointed to each other, a die cavity, the dies being provided in their opposing walls with a first opening and second opening which are communicated with the die cavity; a blow tank movable relatively to the horizontally split type die means and adapted to blow the green sand into the die cavity through the first opening; a vent plate movable relatively to the horizontally split type die means to selectively close the second opening so as to permit only the air from the blow tank to be discharged through the second opening; and a stabbing rod movable relatively to the horizontally split type die means so as to be projected into the die cavity to stab the green sand filled in the die cavity when the blow tank is spaced from the horizontally split type die means.

The above and other objects, features and advantages of the invention will become clear from the following description of the preferred embodiments taken in conjunction with the accompanying drawings.

DESCRIPTION OF THE PREFERRED EMBODIMENTS

Figure 1:
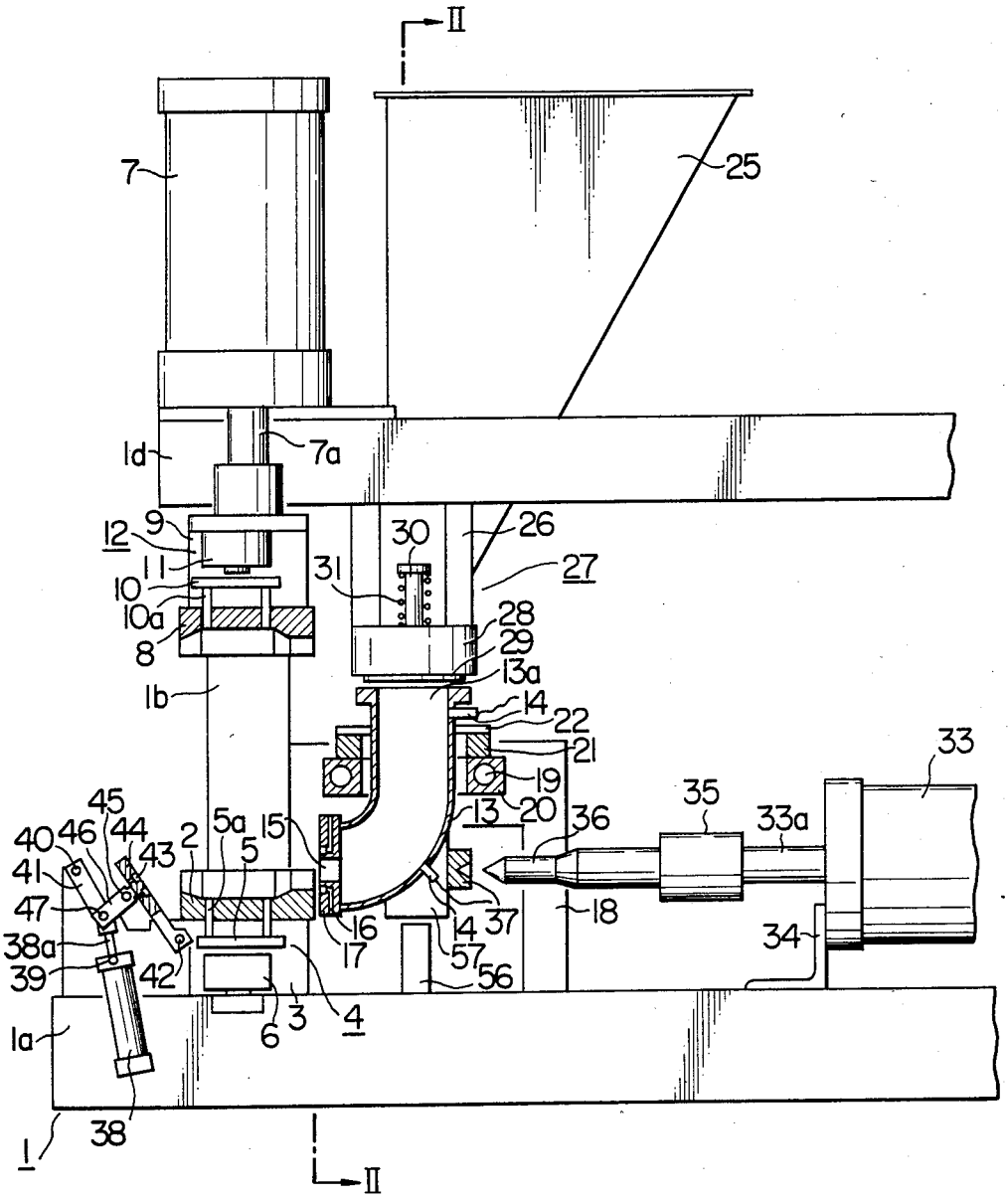
FIG. 1 is a partly-sectioned front elevational view of an embodiment of the core making machine in accordance with the invention.
Figure 2:
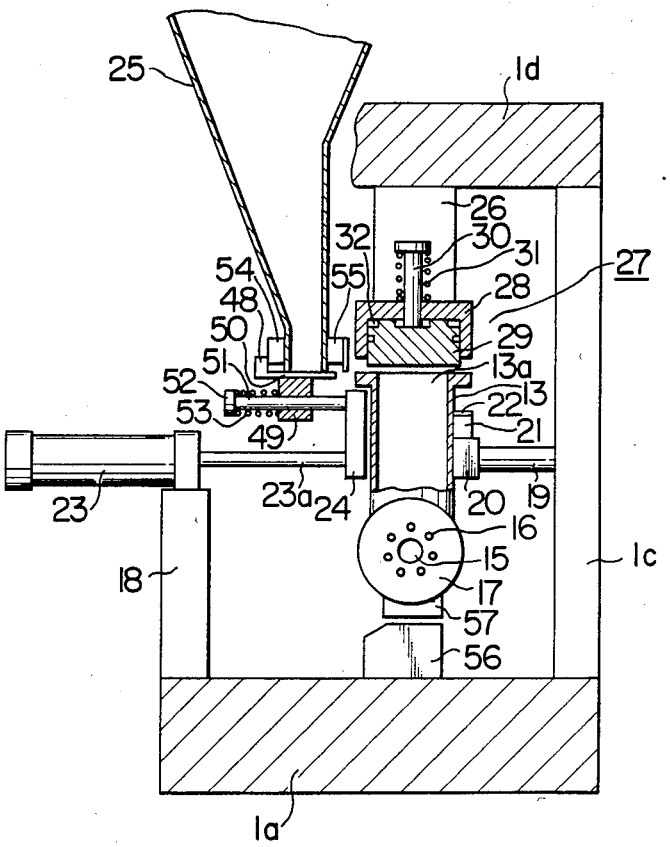
FIG. 2 is a sectional view taken along the line II—II in FIG. 1.

The invention will be fully described hereinunder with reference to the accompanying drawings.

Referring to the drawings, a core making machine in accordance with the invention has a frame generally designated at a reference numeral 1. The frame 1 is composed of a lower frame member 1*a* situated on a bed, vertical frame members 1*b* and 1*c* standing upright from the lower frame member 1*a*, and an upper frame member 1*d* through which both vertical frame members 1*b* and 1*c* are connected. A lower die plate 3 is fixed to the upper surface of the lower frame member 1*a*. The lower die plate 3 has a lower die 2 detachably secured to the upper end surface thereof. A lower mold push-out mechanism 4 is mounted in the lower die plate 3. The lower mold push-out mechanism 4 includes an push-out plate 5 carrying push-out pins 5*a* projectable into the die cavity, and an push-out cylinder 6.

A jointing cylinder 7 is fixed to the upper frame member 1*d* so as to project downwardly therefrom. An upper die 8 is detachably secured to the lower end of the piston rod 7*a* of the jointing cylinder 7, through an upper die plate 9. An upper mold push-out mechanism 12 is mounted in the upper die plate 9. Similarly to the lower die push-out mechanism 4, the upper mold push-out mechanism 12 has a push-out plate 10 carrying push-out pins 10*a* and a push-out cylinder 11.

The lower die 2 and the upper die 8 are so constructed that, when they are brought together, openings are formed at the left and right side walls of these dies in communication with the die cavity.

A reference numeral 13 designates an inversed L-shaped blow tank provided at its upper end with a sand supply port 13*a*. The blow tank 13 is provided at an upper portion and an intermediate portion thereof with air blowing ports 14. A flange 17 fixed to the lower end of the blow tank 13 has a central opening constituting a molding sand blowing hole 15 and a plurality of vent holes 16 around the molding sand blowing hole 15 provided with respective vent plugs (not shown). A supporting frame member 18 has one end fixed to the upper surface of the lower frame 1*a* and the other end fixed to the vertical frame member 1*b*. A pair of guide pins 19 are connected between the supporting frame member 18 and the vertical frame member 1*c* at both sides of the blow tank 13 with slight gaps from respective side surfaces of the blow tank 13. A guide sleeve 20 slidably fits around each guide pin 19. A rubbery elastic member 21 is adhered to the upper surfaces of the guide sleeve 20 so as to surround the blow tank 13 with a suitable gap left therebetween. A frame-like supporting member 22 projected from the outer wall surface of the blow tank 13 is fixed to the upper surface of the elastic member 21. A cylinder 23 is secured to the upper surface of the supporting frame 18 so as to extend horizontally. The cylinder 23 has a piston rod 23*a* the end of which is connected to a connecting plate 24 which is connected between the pair of guide sleeves 20. The arrangement is such that the operation of the cylinder 23 is transmitted to the blow tank 13 through the connecting plate 24, guide sleeves 20, elastic member 21 and the supporting members 22, so that the blow tank 13 is adapted to slide along the guide pins 19 between a sand blowing position in which the lower die 2 and the upper die 8 are brought together and a sand supplying position in which the blow tank 13 is located just under a hopper 25 which will be mentioned later. A ram cylinder 27 is secured through supporting members 26 to the lower side of the upper frame member 1*d* so as to be suspended therefrom at a position just above the blow tank 13 in the sand blowing position. The ram cylinder 27 has a cylinder tube 23 opened at its lower end, a piston 29 slidably received by the cylinder tube 28, a rod member 30 connected to the piston 29 and slidably extending through the upper plate of the cylinder tube 28, and a compression spring 31 loosely fitted onto the shaft porton of the rod member 30 and acting between the upper surface of the upper plate of the cylinder tube 28 and the upper stepped end portion of the rod member 30. The arrangement is such that, as compressed air is supplied into a space 32 defined by the cylinder tube 28 and the piston 29, the piston 29 is lowered to close the molding sand supply port 13*a* formed in the upper surface of the blow tank 13 in the blowing position. To the contrary, as the compressed air is released from the space 32, the piston 29 is returned by the reactional force produced by the compression spring 31.

A stabbing cylinder 33 is supported to extend horizontally by the upper surface of the lower frame member 1*a* through a supporting bracket 34. A stabbing rod 36 having a pointed end is connected through a connecting member 35 to the end of the piston rod 33*a*. As the stabbing cylinder 33 operates to extend its piston rod 33*a*, the stabbing rod 36 is pressed into a recess formed in a receiving member 37 fixed to the blow tank 13 thereby to press the blow tank 13 against the right side walls of the dies brought together, so that the molding sand blowing hole 15 is brought into direct communication with one end opening of the die cavity. The stabbing rod 36 is projectable into the die cavity through the above-mentioned end opening of the die cavity. A cylinder 38 is swingably supported by a pin 39 and receives a piston rod 38*a*. The end of the piston rod 38*a* is pivotally connected through a pin 47 to the free end of a link 41 which is swingably supported at its base end by a pin 40, and also to one end of a link 46 through the same pin 47. The other end of the link 46 is pivotally connected to a vent plate 44 which is swingably supported at its base end by a pin 42 and provided with vent holes 43 each accommodating a vent plug (not shown). The arrangement is such that, as the cylinder 38 operates, the vent plate 44 is swung around the pin 42 through the links 41 and 46, thereby to close the other end opening of the die cavity.

A gate plate 50 is slidably mounted on the lower end surface of the hopper 25. The gate plate 50 has a step 48 and is provided on the lower surface thereof with a guide portion 49. The guide portion 49 of the guide plate 50 slidingly fits around the guide pin 51 extending horizontally rearwardly from the connecting plate 24. A compression spring 53 loosely fits around the portion of the guide plate pin 51 between the guide portion 49 and a rear end step 52 of the guide pin 51, so as to prevent the rearward movement of the gate plate 50. A horizontal stopper member 54 projects from the portion of the outer surface of the hopper 25 near the lower end opening, so as to be able to abut the step 48 of the gate plate 50. On the other hand, a scraper 55 is provided on the front outer surface of the hopper 25 opposite to the stopper member 54. The green sand supplied into the blow tank 13 is graded to the same level as the upper surface of the blow tank 13 by the scraper 55. A reference numeral 56 designates a stopper member protruding from the upper surface of the lower frame member 1*a* and adapted to stop the blow tank 13 upon contact with an abutment 57 provided on the lower surface of the blow tank 13.

The core making machine of the invention having the construction described hereinbefore operates in a manner which is explained hereinunder.

With the hopper 25 filled with green sand, the cylinder 23 is operated to retract its piston rod 23*a* to move the blow tank 13 rearwardly to the position just under the hopper 25. During this movement of the blow tank 13, the gate plate 50 contacted by the upper flange of the blow tank 13 is moved together with the blow tank 13. Then, a predetermined amount of green sand is supplied into the blow tank 13 from the hopper 25. The rearward movement of the gate plate 50 does not take place before it is contacted by the blow tank 13, because of the presence of the compression spring 53, so that the gate plate 50 is moved together with the blow tank 13 in a fixed positional relationship to the latter. Therefore, the green sand of the hopper 25 is charged into the blow tank 13 without any spile. After the supply of the green sand into the blow tank 13, the cylinder 23 is reversed so that the blow tank 13 is moved forward to the molding sand blowing position just under the ram cylinder 27. During the forward movement to this position, the green sand on the blow tank 13 is graded by the scraper 55 to the same level as the upper end surface of the blow tank 13, while the gate plate 50 is disengaged from the blow tank 13 and is forced back by the reaction force of the compression spring 53 until it contacts the stopper member 54, thereby to close again the lower end opening of the hopper 25. Thereafter, the jointing cylinder 7 operates to extend its piston rod 7*a* thereby to lower the upper die 8 to joint the same to the lower die 2. Meanwhile, the stabbing cylinder 33 operates to extend its piston rod 33*a* to make the end of the stabbing rod 36 fit in the recess formed in the receiving member 37 fixed to the blow tank 13, so as to press the blow tank 13 against the jointed dies overcoming the force of the elastic member 21, thereby to bring the molding sand blowing hole 15 into communication with one end opening of the die cavity. Subsequently, compressed air is supplied into the space 32 in the ram cylinder 27 to lower the piston 29 to make the latter close the sand supply port 13 of the blow tank 13. On the other hand, the cylinder 38 is operated to extend its piston rod 38*a* to swing the vent plate 44 clockwise around the pin 42, through the action of the links 41 and 46, thereby to close the other end opening of the die cavity. Subsequently, the compressed air is blown through the air blowing ports 14 to blow the green sand in the blow tank 13 into the die cavity through the molding sand blowing hole 15. The blowing air is discharged through the vent holes 16 and 43 so that the die cavity is filled with the green sand. After the blowing of the green sand into the die cavity, the compressed air is discharged through the space 32 in the ram cylinder 27 so that the piston 29 is reset to the starting position by the reactional force produced by the compression spring 31, thereby to open the molding sand supply port 13*a*. At the same time, the stabbing cylinder 33 is operated in the retracting direction to retract the stabbing rod 36 from the receiving member 37, thereby to free the blow tank 13. Subsequently, the cylinder 23 operates to retract its piston rod 23*a* so that the blow tank 13 is moved back to the position just under the lower end opening of the hopper 25. Then, the stabbing cylinder 33 operates again to extend its piston rod 33*a* so that the stabbing rod 36 is driven into the green sand filled in the die cavity. At the same time, the cylinder 38 operates to retract its piston rod 38*a* so that the vent plate 44 is swung counter-clockwise thereby to open the other end opening of the die cavity. Consequently, the green sand is compacted and hardened by the pressure produced by the stabbing rod 36 to act towards the inner walls of the die cavity and also in the direction of movement of the stabbing rod 36. Then, the stabbing rod 36 is extracted from the compacted and hardened green sand. Thereafter, while the upper mold push-out mechanism 12 is put into operation to downwardly push the hardened green sand, the jointing cylinder 7 is operated to retract its piston rod 7*a* thereby to lift the upper die 8 to leave the hardened green sand on the upper surface of the lower die 2. Subsequently, the lower die push-out mechanism 4 operates to push the hardened green sand upwardly out from the lower die 2, thereby to part the hardened green sand from the lower die 2. One complete cycle of core making operation is thus completed, and the same cycle is performed repeatedly to produce the desired number of cores.

Although the invention has been described through a specific form, it is to be noted here that the described embodiment is not exclusive and various changes and modifications may be imparted thereto without departing from the scope of the invention.

For instance, the stabbing rod 36 which is stepped in the described embodiment can have any other suitable form.

It is also possible to construct such that the lower die 2 is movable vertically towards and away from the upper die 8 which is held stationarily, although in the described embodiment the upper die 8 is adapted to be moved vertically towards and away from the lower die 2 which is stationary.

In the described embodiment, the vent plate 44 is swung to open the other end opening of the die cavity after the driving of the stabbing rod 36 into the green sand filled in the die cavity. This, however, is not exclusive and the operation may be such that the stabbing rod 36 is further driven to compact and harden the green sand and then extracted followed by the swinging of the vent plate 44 to the opening position.

As has been described, according to the invention, it is possible to automatically make a core having the desired hardness, reliably and easily, from less-expensive green sand. In addition, the core exhibits a good collapsibility after the pouring of molten metal, as well as high permeability to gas, because the core thus formed is hollow. In addition, the core can easily be taken out thanks to a rational combination of the horizontally split dies and horizontal sand blowing system.

The core making machine of the invention, through the described advantages, contributes greatly to the development of the field of industry concerned.

What is claimed is:

1. A core making machine for making a hollow core from green sand, comprising:

a horizontally split type die means including a lower die and an upper die movable relatively to the lower die, said lower and upper dies being adapted to define, when they are jointed to each other, a die cavity, said dies being provided in respective opposing side walls thereof with a first opening and second opening communicating with said die cavity;

a blow tank having a blowing hole and a receiving member provided with a recess, said blow tank being movable relatively to said horizontally split type die means and adapted to blow the green sand into said die cavity through said first opening;

a vent plate movable relatively to said horizontally split type die means to selectively close said second opening so as to permit only blowing air from said blow tank to be discharged through said second opening;

and a stabbing rod movable relatively to said horizontally split type die means so as to be projected into said die cavity to stab green sand filled in said die cavity when said blow tank is spaced from said horizontally split type die means, said stabbing rod being adapted to fit in said recess of said receiving member of said blow tank so as to push said blow tank thereby to bring said blowing hole of said blow tank into close contact with said first opening of said horizontally split type die means.

2. A core making machine according to claim 1, wherein said stabbing rod is axially aligned with said first opening of said horizontally split type die means and movable in the axial direction thereof, said blow tank being movable in the direction transverse to the axis of said stabbing rod.

3. A core making machine according to claim 1, wherein said vent plate is pivotable with respect to said horizontally split type die means between a position where it closes said second opening and another position where it is spaced from said second opening.

4. A core making machine according to claim 1, wherein at least one of said lower die and said upper die is provided with a mold push-out mechanism.

5. A core making machine according to claim 1, wherein said blow tank is reciprocally movable between a first position where it blows said green sand into said horizontally split type die means and a second position where it is spaced from said horizontally split type die means, said machine further comprising a hopper for communication with a green sand supply port of said blow tank when said blow tank is in said second position, and a member for closing said sand supply port when said blow tank is in said first position.

6. A core making machine according to claim 1, wherein said blow tank has a flange provided with a central opening defining a sand blowing hole and with a plurality of vent holes arranged around said sand blowing hole, whereby, when the green sand is blown into said horizontally split type die means, the blowing air is discharged through said vent holes.

7. A core making machine according to claim 1, wherein said stabbing rod is adapted to stab said green said in said die cavity while said second opening is closed by said vent plate.

8. A core making machine according to claim 1, wherein said stabbing rod is constituted by a stepped rod.

9. A core making machine according to claim 1, wherein said stabbing rod is constituted by a tapered rod.

* * * * *